US007371198B2

(12) United States Patent
Pai

(10) Patent No.: US 7,371,198 B2
(45) Date of Patent: May 13, 2008

(54) RACKET FRAME

(76) Inventor: Chin-Dong Pai, 20-3 Fl., No. 123, Sec. 3, Jonggang Rd., Taichung (TW)

( * ) Notice: Subject to any disclaimer, the term of this patent is extended or adjusted under 35 U.S.C. 154(b) by 0 days.

(21) Appl. No.: 11/786,502

(22) Filed: Apr. 12, 2007

(65) Prior Publication Data

US 2008/0039244 A1 Feb. 14, 2008

(30) Foreign Application Priority Data

Aug. 11, 2006 (CN) ..... 2006 2 0062953 U

(51) Int. Cl.
*A63B 49/02* (2006.01)

(52) U.S. Cl. ..... 473/546

(58) Field of Classification Search ..... 473/524, 473/535, 546, 553

See application file for complete search history.

(56) References Cited

U.S. PATENT DOCUMENTS

| | | | | |
|---|---|---|---|---|
| 2,456,023 | A * | 12/1948 | Rosenbalm | 473/541 |
| 3,912,268 | A * | 10/1975 | Robinson | 473/537 |
| 4,394,014 | A * | 7/1983 | Balaban | 473/546 |
| 5,060,944 | A * | 10/1991 | Janes | 473/539 |
| 6,537,164 | B1 * | 3/2003 | Hsu | 473/521 |
| 7,081,055 | B2 * | 7/2006 | Hsu | 473/521 |
| 2006/0052187 | A1 * | 3/2006 | Pai | 473/546 |

* cited by examiner

*Primary Examiner*—Raleigh W. Chiu
(74) *Attorney, Agent, or Firm*—William E. Pelton, Esq.; Cooper & Dunham LLP

(57) ABSTRACT

A racket frame has a head hoop, a connecting segment, a handle and two prestressing devices. The head hoop has a bottom end and a string. The connecting segment is connected with the head hoop and has a yoke, two shafts and a throat. The yoke is formed on the bottom end of the head hoop. The shafts are respectively mounted with the yoke and each shaft has a mounting hole. The handle is connected with the connecting segment. The prestressing devices are attached to the shafts in the mounting holes.

10 Claims, 9 Drawing Sheets

RACKET FRAME

BACKGROUND OF THE INVENTION

1. Field of the Invention

The present invention relates to a racket frame, and more particularly to a racket frame with a prestressing device to provide an enhanced structure.

2. Description of Related Art

With reference to FIG. 9, a conventional racket frame (60) is made of carbon fiber and epoxy resin composite and used for playing with a tennis ball or a paddleball and has a head hoop (61), a connecting segment (62) and a handle (63).

The head hoop (61) is connected with a string (611) and has an inner surface and a bottom end. The string (611) is wound on the inner surface of the head hoop (61) in a crisscross manner.

The connecting segment (62) is connected with the head hoop (61) and has a yoke (621), two shafts (622) and a throat (623). The yoke (621) is formed on the bottom end of the head hoop (61). The shafts (622) are arc shaped, are respectively mounted with the yoke (621) and each shaft (622) has an upper end, a lower end, a front side and a rear side. The upper ends of the shafts (622) are respectively connected to the yoke (621). The throat (623) is connected to the lower ends of the shafts (622).

The handle (63) is connected with the connecting segment (62) and has a proximal end. The proximal end of the handle (63) is connected with the throat (623).

When the tennis ball or a paddleball hitting on the string (611), the front sides of the shafts (622) bear a tensile stress and the rear sides of the shafts (622) bear a compressive stress because the shafts (622) are made of material of carbon fiber and epoxy resin composite. The material has a property that its tensile strength is much better than the its compressive strength. So the conventional racket frame (60) always broken from the compressed side if the conventional racket frame (60) was broken cause by overloading.

The invention provides a racket frame that can mitigate or obviate the aforementioned problems.

SUMMARY OF THE INVENTION

The main objective of the present invention is to provide a racket frame with a prestressing device to provide an advanced tensile force to the corresponding shafts. So there will be tensile stress in the shaft even the racket frame is in free condition (is not hitting at a ball). When the racket frame (with prestressing device) is hitting at a ball, the front side of the shaft will has a larger tensile stress, and the rear side of the shaft will release the existed tensile stress completely before it gets compressive stress. Then, the racket frame with prestressing device will bear a larger tensile stress and a smaller compressive stress when it is hitting a ball compares to the racket frame without the prestressing device. Because it's tensile strength is much better than it's compressive strength. So on the whole, the racket frame's strength will be enhanced if it has the prestressing device.

Furthermore, when the racket frame with the prestressing device hitting a ball, the rear side of the shaft will release the existed tensile stress (tensile strain) first, so it's softer in this moment. The racket frame will become stiffer when the existed tensile stress was released completely. In other words, the racket frame will have two different stiffness steps, soft in first moment and stiff in the rest of the period of hitting a ball.

The racket frame has a head hoop, a connecting segment, a handle and two prestressing devices. The head hoop has a bottom end and a string. The connecting segment is connected with the head hoop and has a yoke, two shafts and a throat. The yoke is formed on the bottom end of the head hoop. The shafts are respectively mounted with the yoke and each shaft has a mounting hole. The handle is connected with the connecting segment. The prestressing devices are attached to the shafts in the mounting holes.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
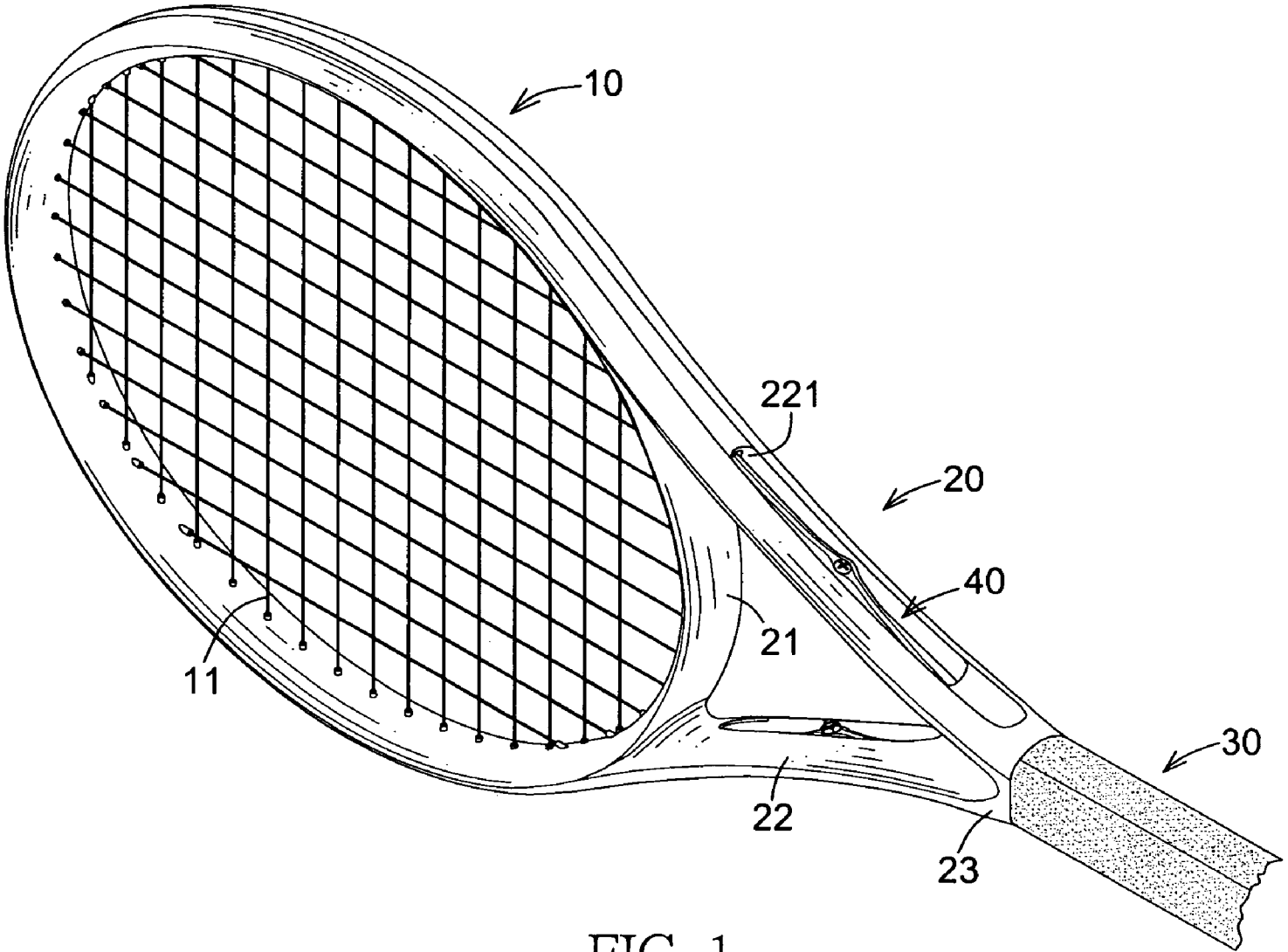
FIG. 1 is a perspective view of a racket frame in accordance with the present invention.
Figure 4:
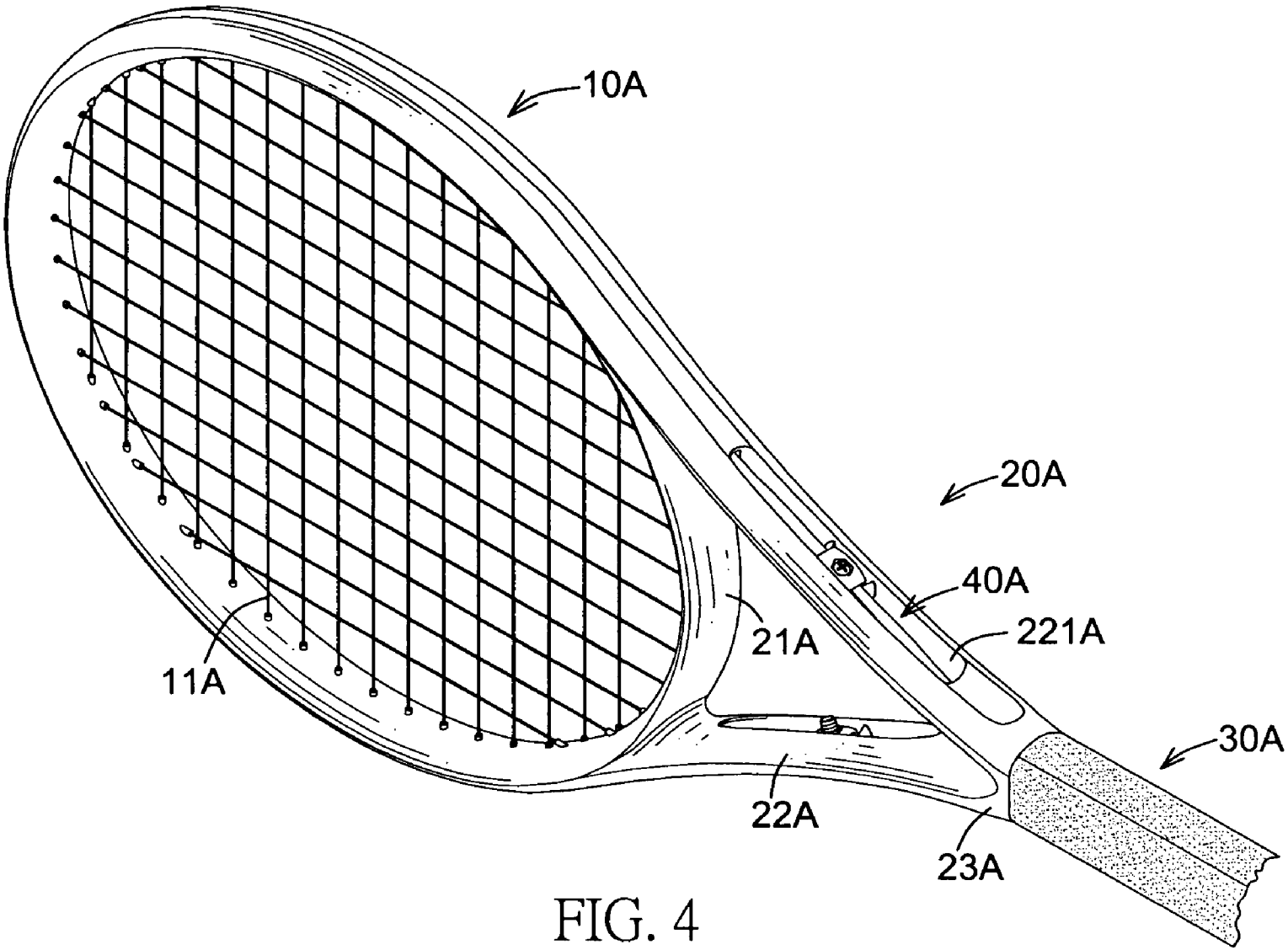
FIG. 4 is a perspective view of a second embodiment of a racket frame in accordance with the present invention.

With reference to FIGS. 1 and 4, a racket frame in accordance with the present invention comprises a head hoop (10, 10A), a connecting segment (20, 20A), a handle (30, 30A) and two prestressing devices (40, 40A).

The head hoop (10, 10A) may be elliptical, is used to connect with a string (11, 11A) and has an inner surface and a bottom end. The string (11, 11A) is wound on the inner surface of the head hoop (10, 10A) in a crisscross manner.

Figure 2:
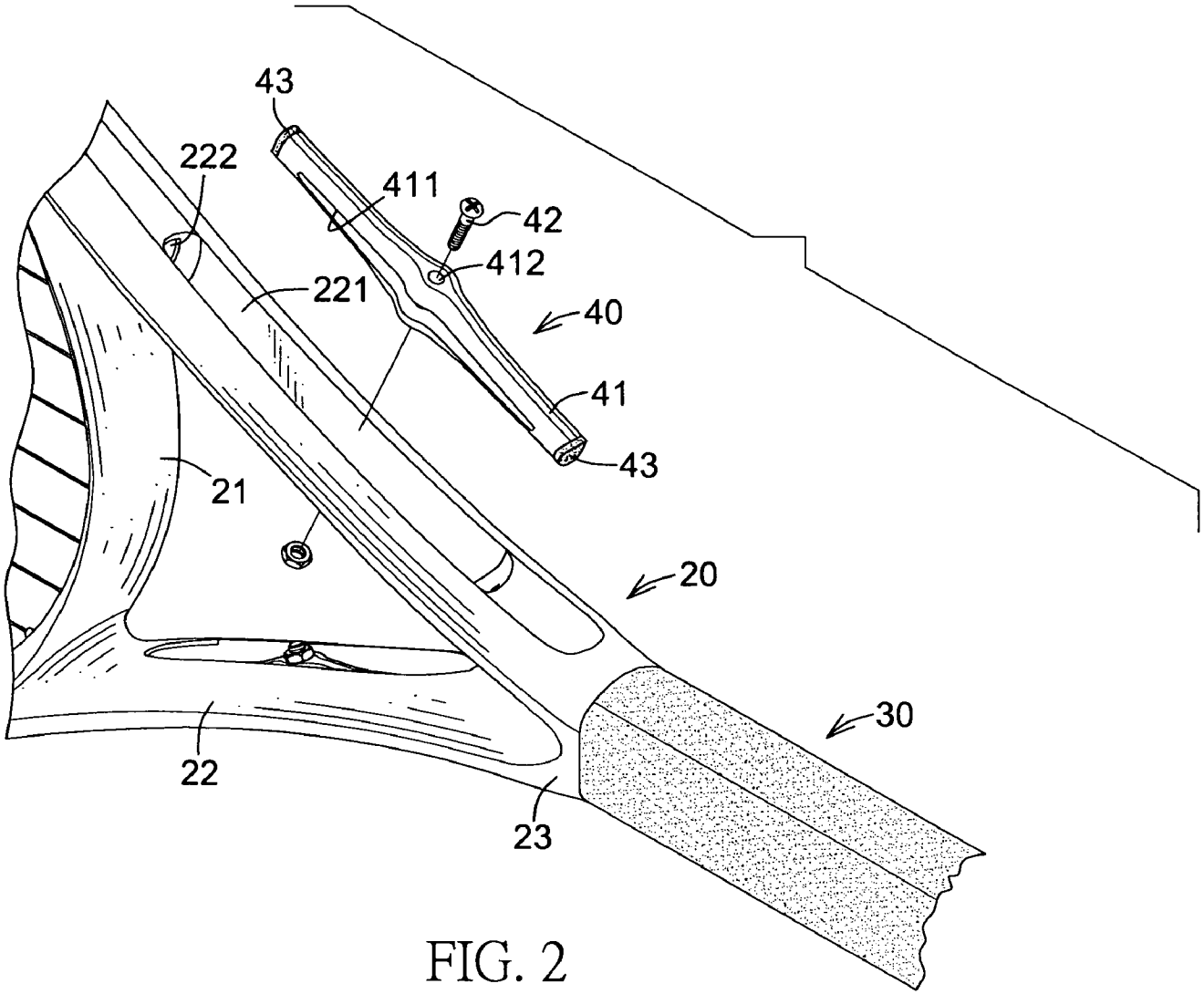
FIG. 2 is an exploded perspective view of the racket frame in FIG. 1.
Figure 5:
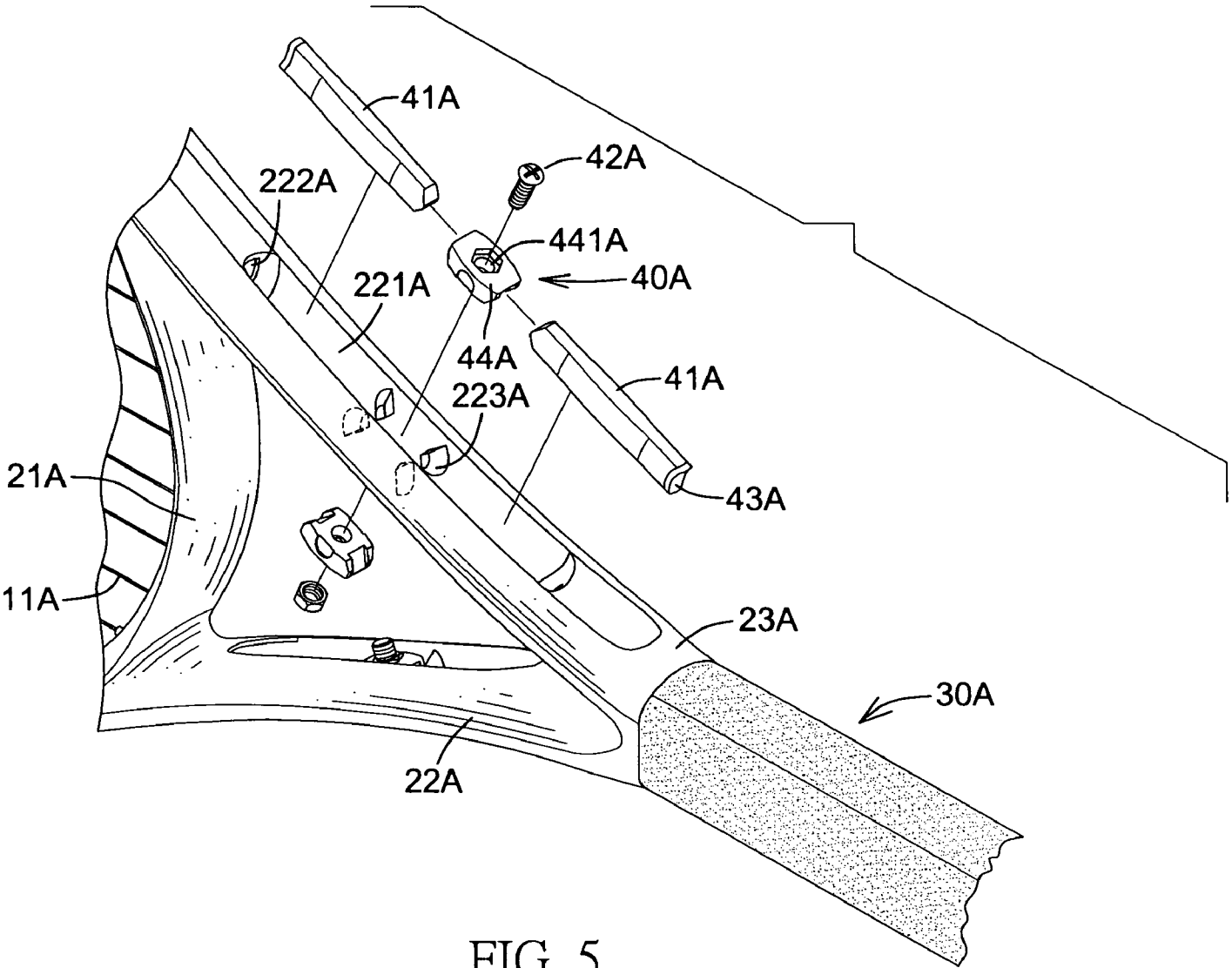
FIG. 5 is an exploded perspective view of the racket frame in FIG. 4.

With further reference to FIGS. 2 and 5, the connecting segment (20, 20A) may be inverted triangle shaped, is connected with the head hoop (10, 10A) and has a yoke (21, 21A), two shafts (22, 22A) and a throat (23, 23A). The yoke (21, 21A) is formed on the bottom end of the head hoop (10, 10A). The shafts (22, 22A) may be arc shaped and are respectively mounted with the yoke (21, 21A), and each shaft (22, 22A) has an internal surface, a front side, a rear side, an upper end, a lower end, two sidewalls, a mounting hole (221, 221A) and two inserting recesses (222, 222A). The upper ends of the shafts (22, 22A) are respectively connected to the yoke (21, 21A). The mounting hole (221, 221A) may be elongated, curved or rectangular, is formed through the sidewalls of the shaft (22, 22A) between the upper end and the lower end. The inserting recesses (222, 222A) are respectively formed in shaft (22, 22A) near the upper end and the lower end, are communicated with the mounting hole (221, 221A). The throat (23, 23A) is connected to the lower ends of the shafts (22, 22A).

The handle (30, 30A) is connected with the connecting segment (20, 20A) and has a proximal end. The proximal end of the handle (30, 30A) is connected with the throat (23, 23A) of the connecting segment (20, 20A).

Figure 3:
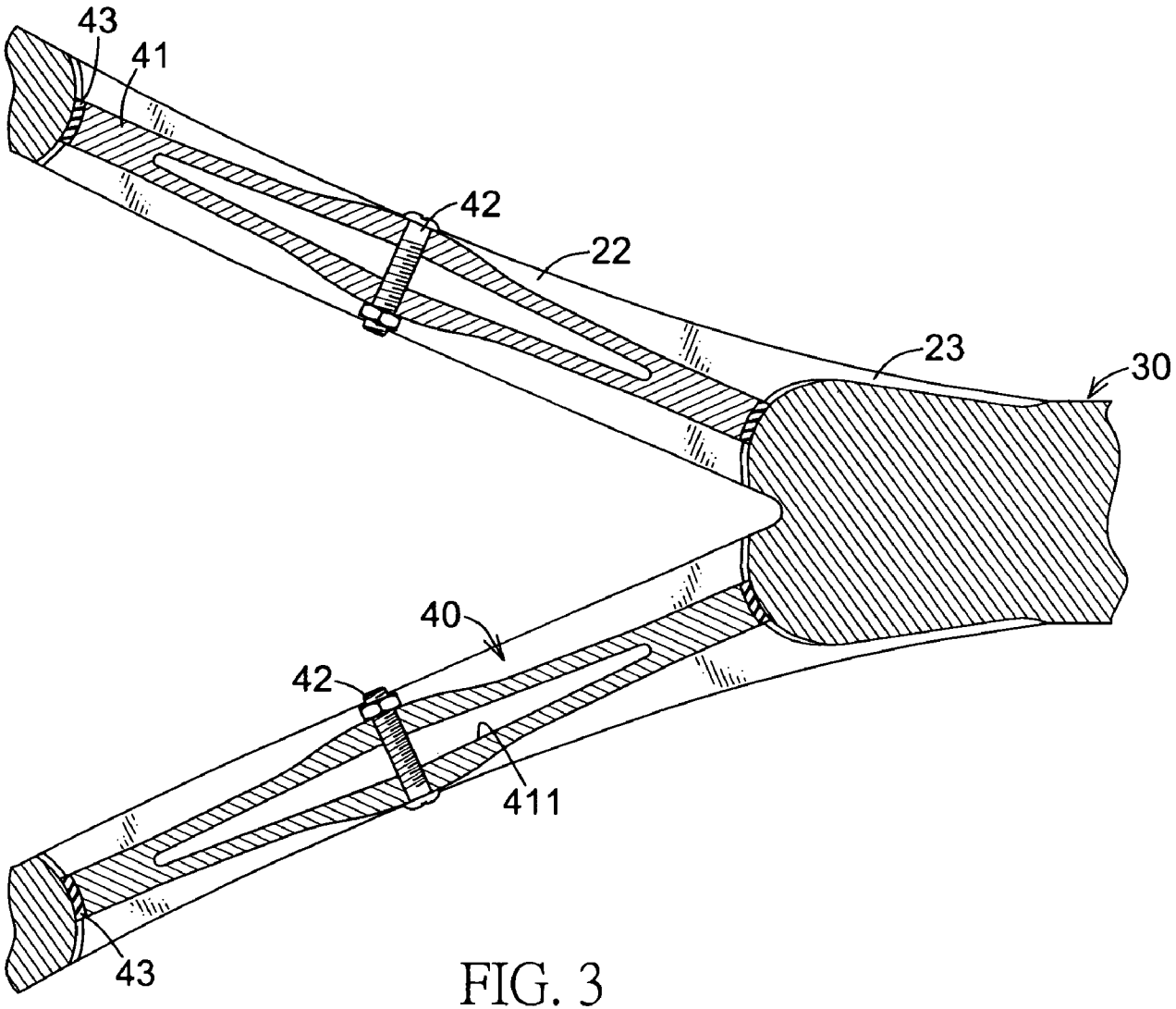
FIG. 3 is a side view in partial section of the racket frame in FIG. 1.

With reference to FIGS. 2 and 3, the prestressing devices (40) are attached to the shafts (22) in the mounting holes (221) and each prestressing device (40) has a prestressing pole (41), an adjusting bolt (42) and two spacers (43). The prestressing pole (41) may be made of carbon fiber, glass fiber, plastic material or compound material, is inserted into a corresponding mounting hole (221) of the shaft (22) and has two ends, a middle, a through hole (411) and two adjusting holes (412). The ends of the prestressing pole (41) are respectively inserted into the inserting recesses (222) of the shaft (22). The through hole (411) is formed through the prestressing pole (41) between the ends and is communicated with the corresponding mounting hole (221). The adjusting holes (412) are respectively formed radially through the prestressing pole (41) in the middle and are communicated with the through hole (411), and each adjusting hole (412) has an inner thread. The adjusting bolt (42) is screwed with the adjusting holes (412) in the prestressing pole (41) and has an outer thread. The outer thread of the adjusting bolt (42) is screwed securely with the inner threads of the adjusting holes (412) with a nut. Then, a user can rotate the adjusting bolt (42) to compress against the prestressing pole (41) in cooperation with the nut so as to adjust the length of the prestressing pole (41) and change the pre-stress of the corresponding shaft (22). The spacers (43) are respectively mounted on the ends of the prestressing pole (41) to securely attach the prestressing pole (41) with the shaft (22) and provide a shock and vibration absorbing and depressing effect.

Figure 6:
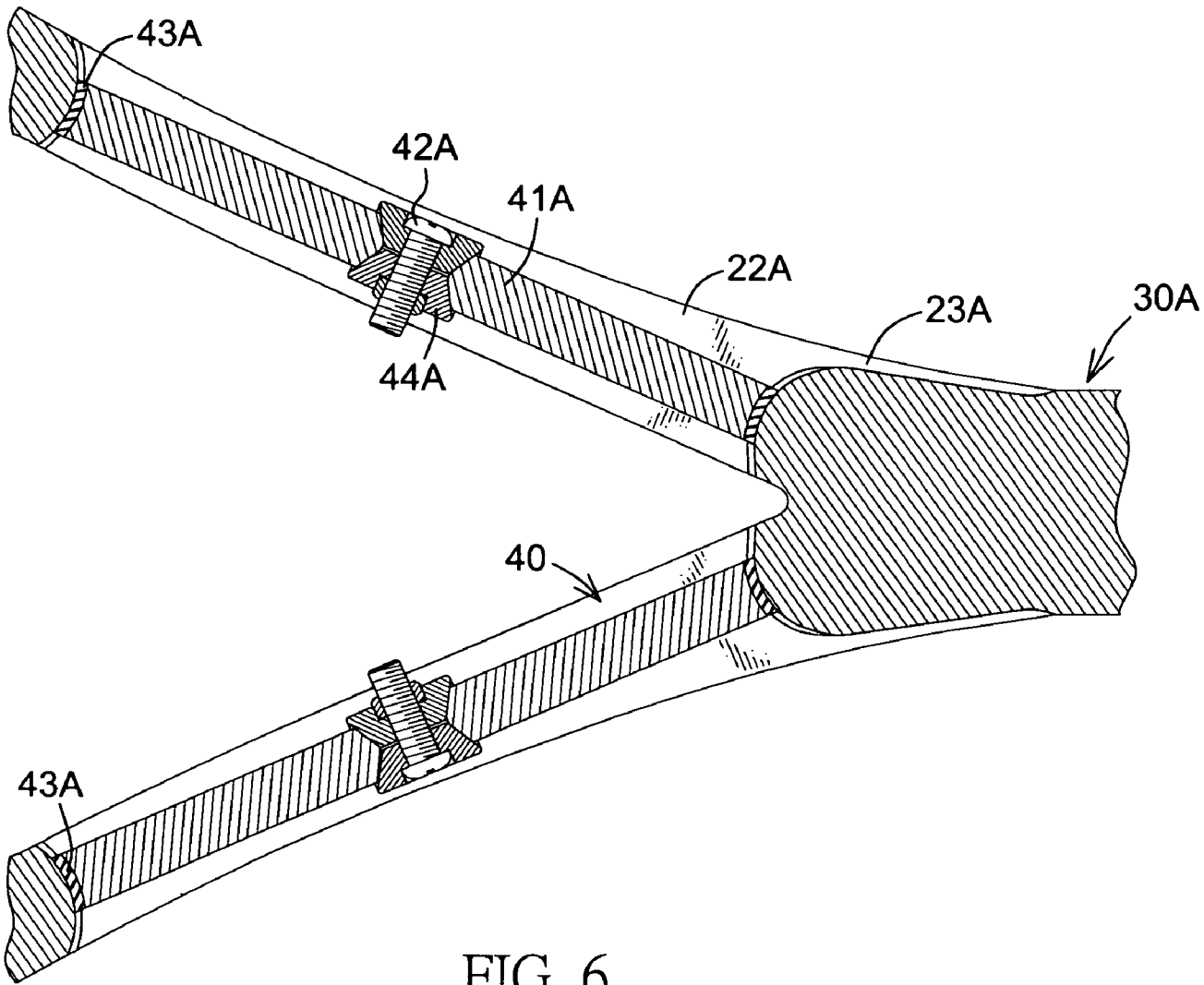
FIG. 6 is a side view in partial section of the racket frame in FIG. 4.

With reference to FIGS. 5 and 6, a second embodiment of a racket frame in accordance with the present invention has a structure substantially same as that of the previous embodiment except that each shaft (22A) further has two connecting hooks (223A) and each prestressing device (40A) has two engaging blocks (44A), an adjusting bolt (42A), two prestressing poles (41A) and two spacers (43A). The connecting hooks (223A) are respectively formed on the internal surface of the shaft (221A) near the middle and face each other. The engaging blocks (44A) abut respectively against the corresponding shaft (22A) between the connecting hooks (223A). Each engaging block (44A) has a screw hole (441A) formed through the engaging block (44A) and communicates with the screw hole (441A) of the other engaging block (44A). The adjusting bolt (42A) extends through the engaging blocks (44A) and is screwed with the screw holes (441A) with a nut. The prestressing poles (41A) are respectively attached securely to the corresponding shaft (22A) in the mounting hole (221A) and abut against the engaging blocks (44A) and the inserting recesses (222A). Each prestressing pole (41A) has a pointed end and an obtuse end. The pointed ends of the prestressing poles (41A) abut against the engaging blocks (44A). The obtuse ends of the prestressing poles (41A) are inserted into the inserting recesses (222A) of the shaft (22A). The spacers (43A) are respectively mounted on the obtuse ends of the prestressing poles (41A) and are attached to the inserting recesses (222A).

Then, user can rotate the adjusting bolt (42A) with the nut to adjust the distance between the engaging blocks (44A) and push against the prestressing poles (41A). With the rotation of the adjusting bolt (42A), the pre-stress of the corresponding shaft (22A) can be changed due to the change of length of the prestressing poles (41A).

Figure 7:
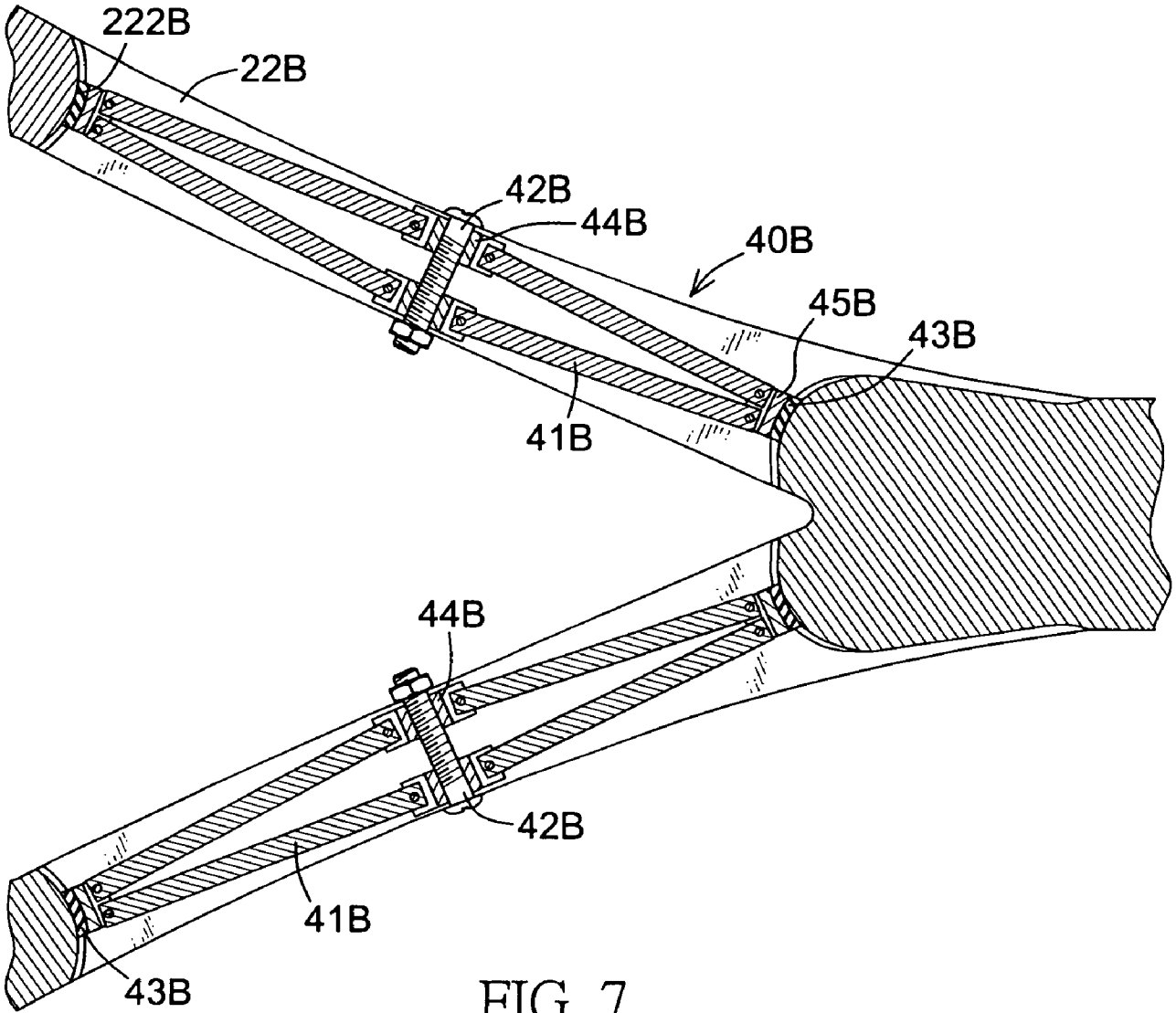
FIG. 7 is a side view in partial section of a third embodiment of a racket frame in accordance with the present invention.

With reference to FIG. 7, a third embodiment of a racket frame in accordance with the present invention has a structure substantially same as that of the previous embodiments except that each prestressing device (40B) has two engaging blocks (44B), an adjusting bolt (42B), four prestressing poles (41B), two connecting blocks (45B) and two spacers (43B). The engaging blocks (44B) are defined in the corresponding shaft (22B) and each engaging block (44A) has a screw hole (441B) formed through the engaging block (44B) and communicates with the screw hole (441B) of the other engaging block (44B). The adjusting bolt (42B) extends through the engaging blocks (44B) and is screwed with the screw holes (441B) with a nut. The prestressing poles (41B) are respectively attached securely to the corresponding shaft (22B) and connected pivotally to the engaging blocks (44B). Each prestressing pole (41B) has a front end and a rear end. The front ends of the prestressing poles (41B) connected to the engaging blocks (44B). The connecting blocks (45B) are connected to the rear ends of the prestressing poles (41B). The spacers (43B) are respectively mounted on the connecting blocks (45B) oppositely to the rear ends of the prestressing poles (41B) and are attached to the inserting recesses (222B).

Then, user can rotate the adjusting bolt (42B) with the nut to adjust the distance between the engaging blocks (44B) and push against the prestressing poles (41B). With the rotation of the adjusting bolt (42B), the pre-stress of the corresponding shaft (22B) can be changed due to the change of length of the prestressing poles (41B).

Figure 8:
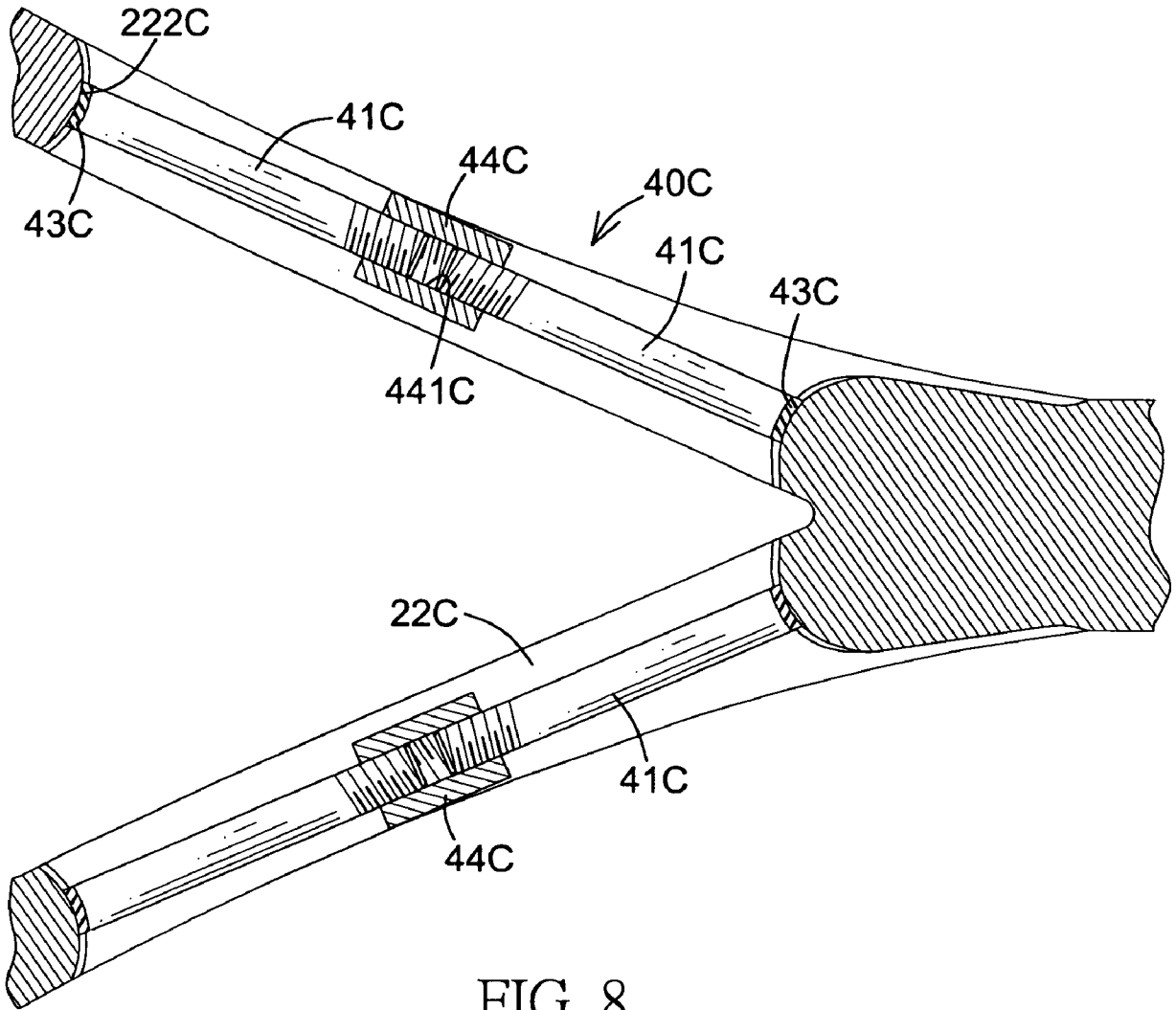
FIG. 8 is a side view in partial section of a fourth embodiment of a racket frame in accordance with the present invention.
Figure 9:
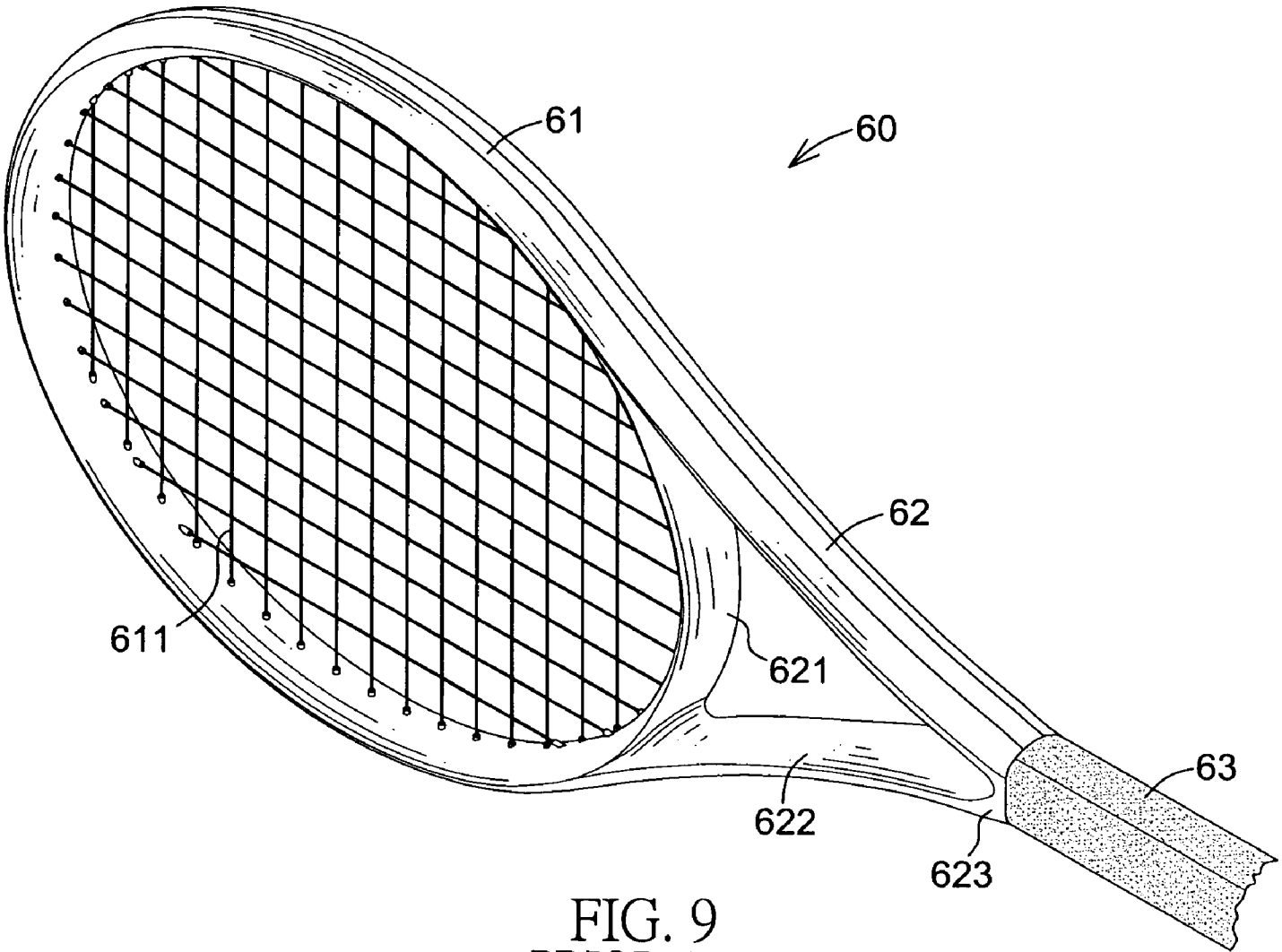
FIG. 9 PRIOR ART
FIG. 9 is a perspective view of a conventional racket frame in accordance with the prior art.

With reference to FIG. 8, a fourth embodiment of a racket frame in accordance with the present invention has a structure substantially same as that of the previous embodiments except that each prestressing device (40C) has an engaging block (44C), two prestressing poles (41C) and two spacers (43C). The engaging block (44C) is defined in the corresponding shaft (22C) and has two ends and a screw hole (441C). The screw hole (441C) is formed axially through the ends of the engaging block (44C). The prestressing poles (41C) are respectively attached securely to the corresponding shaft (22C) and screwed with the engaging block (44C). Each prestressing pole (41C) has a front end and a rear end. The front ends of the prestressing poles (41C) are screwed with the screw hole (441C) of the engaging blocks (44C). The spacers (43C) are respectively mounted on the rear ends of the prestressing poles (41C) and attached to the inserting recesses (222C).

Then, user can rotate the engaging block (44C) to adjust the distance between the prestressing poles (41C). With the rotation of the engaging block (44C), the pre-stress of the corresponding shaft (22C) can be changed due to the change of length of the prestressing poles (41C).

The racket frame has the following advantages.

1. The racket frame with the prestressing devices (40, 40A), the strength of the racket frame will be enhanced.

2. The racket frame with the prestressing devices (40, 40A) and has two different stiffness steps, can keep the ball in contact with the string (11, 11A) for a long time. Thus giving the players more control, more touch and more feel. This can give user more power because the ball stay longer time will give the string (11, 11A) more time to accelerate the ball, and the ball will receive more momentum from the shot.

3. Users can adjust the pre-stress of the shafts (22, 22A, 22B, 22C) by rotating the adjusting bolt (42, 42A, 42B) with the nut to change the length of the prestressing pole (41A, 41B, 41C) or the distance of the engaging blocks (44A, 44B, 44C) easily and quickly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A racket frame having a head hoop with a bottom end;

a connecting segment being connected with the head hoop and having a yoke being formed on the bottom end of the head hoop;

two shafts being respectively mounted with the yoke and each shaft having an internal surface;

an upper end being connected to the yoke;

a lower end;

two sidewalls; and a mounting hole being formed through the sidewalls of the shaft between the upper end and the lower end; and a throat being connected to the lower ends of the shafts;

a handle being connected with the connecting segment and has a proximal end connected with the throat of the connecting segment; and two prestressing devices being attached to the shafts in the mounting holes.

2. The racket frame as claimed in claim 1, wherein each shaft has two inserting recesses being respectively formed in the shaft near the upper end and the lower end and being communicated with the mounting hole; and each prestressing device has a prestressing pole being inserted into the mounting hole in a corresponding shaft and having two ends being respectively inserted into the inserting recesses of the corresponding shaft;

a middle;

a through hole being formed through the prestressing pole and being communicated with the corresponding mounting hole; and two adjusting holes being respectively formed radially through the prestressing pole in the middle and being communicated with the through hole, and each adjusting hole having an inner thread; and an adjusting bolt being screwed with the adjusting holes in the prestressing pole and having an outer thread screwed with the inner threads of the adjusting holes.

3. The racket frame as claimed in claim 2, wherein each prestressing device has two spacers respectively mounted on the ends of the prestressing pole.

4. The racket frame as claimed in claim 1, wherein each shaft having two inserting recesses being respectively formed in shaft near the upper end and the lower end and being communicated with the mounting hole;

a middle; and two connecting hooks being respectively formed on the internal surface of the shaft near the middle and facing each other; and each prestressing device having two engaging blocks abutting respectively against a corresponding shaft between the connecting hooks, and each engaging block having a screw hole formed through the engaging block and communicated with the screw hole in the other engaging block;

an adjusting bolt extending through the engaging blocks and screwed with the screwed holes; and two prestressing poles being respectively attached securely to the corresponding shaft in the mounting hole and abutting against the engaging blocks and the inserting recesses in the corresponding shaft, and each prestressing pole having a pointed end abutting against the engaging blocks; and a obtuse end being inserted into one of the inserting recesses of the corresponding shaft.

5. The racket frame as claimed in claim 4, wherein each prestressing device has two spacers respectively mounted on the obtuse ends of the prestressing poles and attached to the inserting recesses in the corresponding shaft.

6. The racket frame as claimed in claim 1, wherein each shaft has two inserting recesses being respectively formed in the shaft near the upper end and the lower end; and each prestressing device has two engaging blocks being defined in the corresponding shaft and each engaging block having a screw hole formed through the engaging block and communicates with the screw hole of the other engaging block;

an adjusting bolt being extended through the engaging blocks and being screwed with the screw holes;

four prestressing poles being respectively attached securely to the corresponding shaft and connected pivotally to the engaging blocks, and each prestressing pole having a front end being connected to the engaging blocks; and a rear end;

two connecting blocks being connected to the rear ends of the prestressing poles; and two spacers being respectively mounted on the connecting blocks oppositely to the rear ends of the prestressing poles and being attached to the inserting recesses.

7. The racket frame as claimed in claim 1, wherein each shaft has two inserting recesses being respectively formed in the shaft near the upper end and the lower end; and each prestressing device has an engaging block being defined in the corresponding shaft and having two ends; and a screw hole being formed axially through the ends of the engaging block;

two prestressing poles being respectively attached securely to the corresponding shaft and screwed with the engaging block, and each prestressing pole having a front end being screwed with the screw hole of the engaging block; and a rear end; and two spacers being respectively mounted on the rear ends of the prestressing poles and being attached to the inserting recesses.

8. The racket frame as claimed in claim 1, wherein the head hoop is elliptical.

9. The racket frame as claimed in claim 1, wherein the connecting segment is inverted triangle shaped.

10. The racket frame as claimed in claim 1, wherein the mounting hole in each shaft is elongated.

* * * * *